US007191727B2

(12) United States Patent
Buzzi

(10) Patent No.: US 7,191,727 B2
(45) Date of Patent: Mar. 20, 2007

(54) SYSTEM FOR POSITIONING AND RETAINING REMOVABLE TUBULAR ELEMENTS TO BE FASTENED TO A BOAT HULL

(75) Inventor: Fabio Buzzi, Oggiono (IT)

(73) Assignee: FB Design S.r.l., Annone Brianza (IT)

( * ) Notice: Subject to any disclaimer, the term of this patent is extended or adjusted under 35 U.S.C. 154(b) by 0 days.

(21) Appl. No.: 10/936,819

(22) Filed: Sep. 9, 2004

(65) Prior Publication Data

US 2005/0051077 A1 Mar. 10, 2005

(30) Foreign Application Priority Data

Sep. 10, 2003 (IT) ..... MI2003A1733

(51) Int. Cl.
*B63B 7/08* (2006.01)
*B63B 5/24* (2006.01)

(52) U.S. Cl. ..... 114/345; 114/357

(58) Field of Classification Search ..... 114/345, 114/357, 360, 219
See application file for complete search history.

(56) References Cited

U.S. PATENT DOCUMENTS

| | | | | |
|---|---|---|---|---|
| 3,093,847 | A * | 6/1963 | Strecker | 114/357 |
| 3,812,805 | A * | 5/1974 | Forssell et al. | 114/61.25 |
| 4,142,265 | A * | 3/1979 | Pfleger | 114/357 |
| 4,760,811 | A * | 8/1988 | Hopper | 114/65 R |
| 4,804,347 | A * | 2/1989 | Ross | 441/79 |
| 4,946,727 | A | 8/1990 | Kessler | |
| 5,988,094 | A | 11/1999 | Obrinski | |
| 6,371,040 | B1 | 4/2002 | Hemphill et al. | |

FOREIGN PATENT DOCUMENTS

WO WO 02/092421 11/2002

* cited by examiner

*Primary Examiner*—Sherman Basinger
(74) *Attorney, Agent, or Firm*—Nixon & Vanderhye P.C.

(57) ABSTRACT

A positioning and retaining system for removable tubular elements to be fastened to the hull of a boat includes at least one guide that can be coupled to at least one of the removable tubular elements. This guide is advantageously embedded within the boat hull.

8 Claims, 3 Drawing Sheets

SYSTEM FOR POSITIONING AND RETAINING REMOVABLE TUBULAR ELEMENTS TO BE FASTENED TO A BOAT HULL

This application claims priority to IT Application No. MI2003A 001733, filed 10 Sep. 2003. The entire contents of this application is incorporated herein by reference.

BACKGROUND OF THE INVENTION.

The present invention relates to a system for positioning and retaining removable tubular elements suitable to be fastened to a boat hull, such as safety tubular elements, and a method therefor.

A pneumatic tubular element is known to be fastened to a boat hull by gluing (in order to create a so-called R.I.B., Rigid Inflatable Boat); the removable clamping of this tubular element by inserting shaped parts of the removable tubular elements in linear guides longitudinally running, either partially or totally, along the boat hull is far less common. On the one hand, the inflatable removable tubular element extending along the boat hull flank is aimed at increasing the safety, stability and floatability of the boat, and on the other hand at preventing possible collisions of the boat against the dock, or other boats while docking, which may damage the hull.

There exist a whole family of rigid-keel pneumatic hulls having a number of advantages and a few drawbacks compared to the rigid hulls.

As to linear guides, they normally follow the surface development of the hull, and accordingly they have a bended or rectilinear run, and are usually manufactured in metal or composite materials, separately from the hull to be consequently made integral with the latter by mechanical clamping means, such as screws or rivets, or by glues.

The preferably concave configuration of the linear guides engages with the shaped parts of the tubular elements, the removable assembly of the latter to the boat being thus facilitated by inserting them when deflated and inflating them later.

However, due to the stresses and vibrations to which these guides, and accordingly the corresponding clamping means, are subjected while the boat is moving, the guide-to-hull fastening usually does not remain unchanged over time, thereby causing a mutual disengagement of the parts, sometimes also deriving from a breakage of the latter.

The material of the hull forming the anchoring support or the guide material can be poorly compatible with the glues employed, or rather they may not carry the mechanical clamping means. The external environment conditions to which the guides and the hull are normally subjected, such as the presence of sea water, are further factors contributing to this guide-to-hull fastening becoming poorly resistant over time.

Furthermore, clamping the guides to the hull involves that the former, without removable tubular elements, will protrude from the hull, thus being a potential colliding surface, and besides this, a protuberance unattractive for the boat users.

SUMMARY OF THE INVENTION

Therefore, it is an object of the present invention to provide a positioning and retaining system for removable tubular elements to be fastened to a boat hull, of the type comprising at least one guide for these inserts, without the drawbacks of the prior art.

Therefore, it is a primary object of the present invention to provide a method for manufacturing a positioning and retaining system for removable tubular elements to be fastened to a boat hull which is simple to be carried out and does not require the use of glues or mechanical clamping means.

Another object of the present invention is to manufacture a positioning and retaining system for removable tubular elements, which allows a quick and reliable assembly of the relative guides to the boat hull.

A further object of the present invention is to provide a boat equipped with removable tubular elements in which the guides for these tubular elements do not involve the above mentioned drawbacks.

These and other objects of the present invention are obtained from the positioning and retaining system for removable tubular elements to be fastened to a boat hull of the invention.

The positioning and retaining system for removable tubular elements to be fastened to a boat hull according to the present invention includes at least one guide to be coupled to at least one of the removable tubular elements, wherein this guide is embedded within the boat hull.

The present invention also provides the following method for manufacturing the positioning and retaining system for removable tubular elements to be fastened to a boat hull, comprising the steps of:

a) removably clamping, either directly or indirectly, to the hull mould at least one guide to be coupled to at least one of the removable tubular elements to the hull mould;

b) laminating a suitable amount of plastic or composite material on this guide-carrying mould to manufacture the hull.

Thereby, following the laminating step, and after removal from the mould, the guide being optionally shaped such that the mechanical coupling with the hull is ensured by contrast of parts, is embedded within the same hull, and clamped thereto without requiring any external mechanical fasteners or glues.

This guide-to-hull coupling is safe and reliable due to the absence of external mechanical fasteners, such as screws or rivets, as well as glues, and if any servicing should be required, it would be easily carried out by common and inexpensive hull-repairing techniques, without having to restore the guide-to-hull coupling.

According to a preferred aspect of the present invention, the guides are furthermore concave and embedded flush to the hull outer surface, such that they cannot be dangerous protuberances for the users or unattractive offshoots of the boat.

In a preferred embodiment of the present invention, the guide is manufactured from a composite or metallic material and the hull, which is laminated on this guide, is obtained from a plastic or composite material, and particularly a pultruded fiberglass.

According to another aspect of the present invention, there is also provided a boat equipped with removable tubular elements to be fastened to the hull to guides integral with the hull, in which at least one of the guides is embedded within the hull.

BRIEF DESCRIPTION OF THE DRAWINGS

A preferred embodiment of the present invention will be illustrated below, by way of non-limiting example, with reference to the annexed drawings in which.

DETAILED DISCUSSION OF PREFERRED EMBODIMENTS

Figure 1:
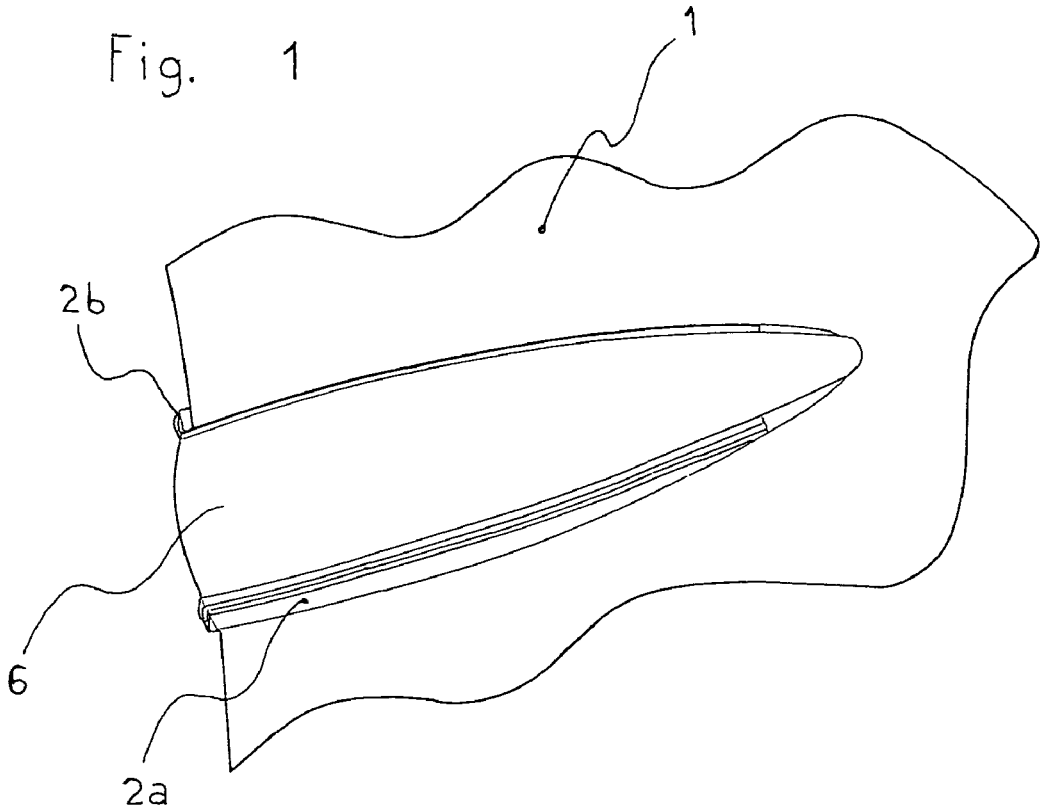
FIG. 1 is a partial cross-sectional view of a boat hull flank provided with the positioning and retaining system for removable tubular elements according to a particular aspect of the invention.
Figure 2:
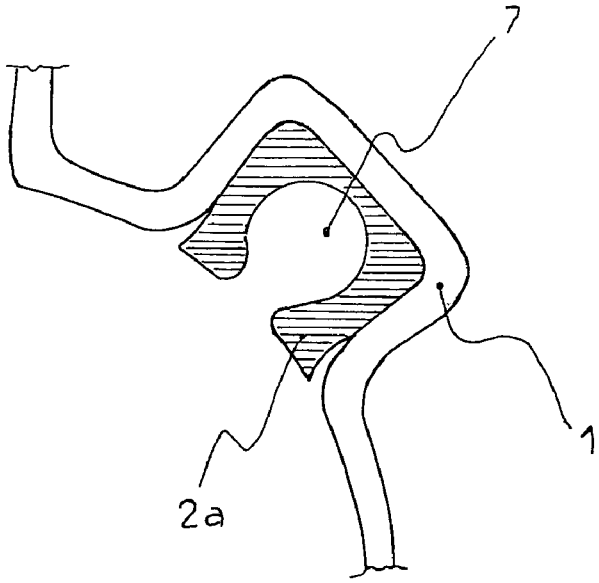
FIG. 2 is a partial sectional view of a guide of the system illustrated in FIG. 1.

With reference to FIGS. 1 and 2, the positioning and retaining system for removable tubular elements to be fastened to the hull 1 of a boat, according to the present invention, comprises one or more guides 2*a*, 2*b*, preferably of a metallic or composite material, being clamped to the hull 1 and to be coupled to a removable tubular element, such as an inflatable tubular element destined to be fastened at the outer flank of the same hull 1.

The guides 2*a*, 2*b*, which in the embodiment from FIG. 1 are two symmetrical linear guides arranged at the edges of a particular area 6 of hull 1 being shaped such as to accommodate a complementary removable tubular element (not illustrated), are advantageously embedded within the same hull 1.

Advantageously, the concavity of area 6 further allows the tubular elements (not illustrated) to be embedded within the hull 1. This arrangement of the tubular elements allows, as will be better understood below, one single mould to be used to obtain both types of hulls, either with or without these tubular elements and guides 2*a*, 2*b*.

The embedding of the linear guides 2*a*, 2*b*, which as will be better understood below, can be simply obtained by laminating the plastic or composite material forming the outer layer of hull 1 directly onto the guides 2*a*, 2*b*, allows to obtain an efficient and long-lasting clamping of these guides 2*a*, 2*b* to the hull 1.

In fact, the absence of external clamping means, such as rivets, screws or glues, not only enables the easier coupling of the linear guides 2*a*, 2*b* with the hull 1, but also involves that the fastening of the guides 2*a*, 2*b* to the hull 1 is developed all the way down the length of each guide 2*a*, 2*b*, without the substantial presence of punctiform (i.e. point) fasteners (e.g. screws or rivets), which may represent dangerous discontinuities in the hull 1.

Furthermore, should the hull 1 break in the vicinity of the coupling with a guide 2*a*, 2*b*, the normal repair of the hull 1, according to conventional techniques will involve the consequent restoration of the fastening of the guide 2*a*, 2*b* to the hull 1.

Should the guides 2*a*, 2*b* have a concavity 7 to accommodate suitably shaped parts of the removable tubular elements, the clamping of the hull 1 and each embedded guide 2*a*, 2*b* further allows (see FIG. 2) to arrange these guides 2*a*, 2*b* substantially flush with the outer surface of the hull 1, thereby avoiding the presence of parts protruding from the boat hull 1, which may be potentially dangerous for the user, as well as being unattractive.

As shown in FIG. 1, the linear guides 2*a*, 2*b* can also follow the development of the surface portion of hull 1, not necessarily being a planar one, without affecting or compromising the coupling of guides 2*a*, 2*b* with the hull 1, contrarily to known prior art.

According to a particular embodiment of the present invention, the positioning and retaining system for removable tubular elements to be fastened to a boat can be preferably provided by laminating the hull 1, or the outer surface layer thereof, directly on the removably mounted guides 2*a*, 2*b*, either directly or indirectly on the mould defining the shape of the hull 1.

More particularly, with reference to FIGS. 3–6, the method for providing the positioning and retaining system for removable tubular elements according to the present invention described above, provides the steps of:

a removably clamping, either directly or indirectly, the guides 2*a*, 2*b* onto the mould 3 of hull 1;

b laminating a suitable amount of plastic or composite material (such as pultruded fibreglass) onto the mould 3 for manufacturing the hull 1;

c releasing each guide 2*a*, 2*b* from the mould 3; and d removing the mould 3 from the laminated material.

Figure 3:
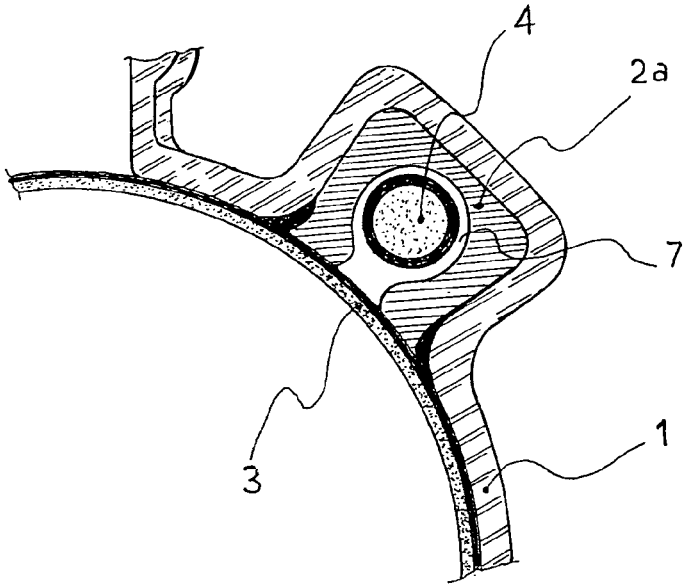
FIG. 3 is a sectional view of a mould, a boat hull being laminated thereon to obtain a positioning and retaining system, according to another aspect of the present invention.
Figure 4:
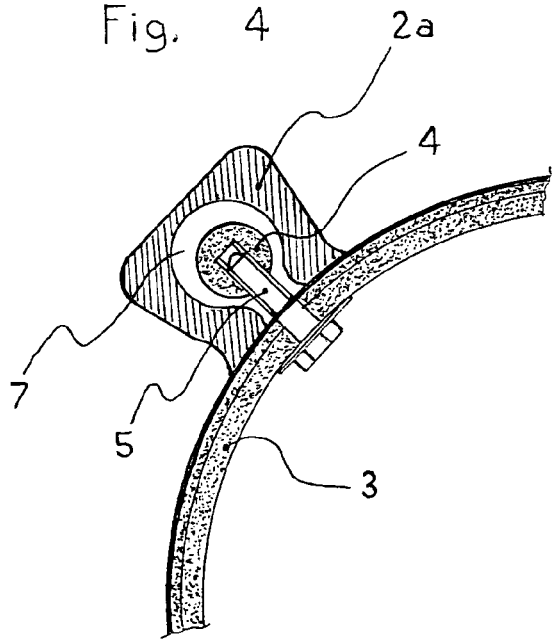
FIG. 4 is a sectional view of a mould to obtain a positioning and retaining system for removable tubular elements, according to a further aspect of the present invention.
Figure 5:
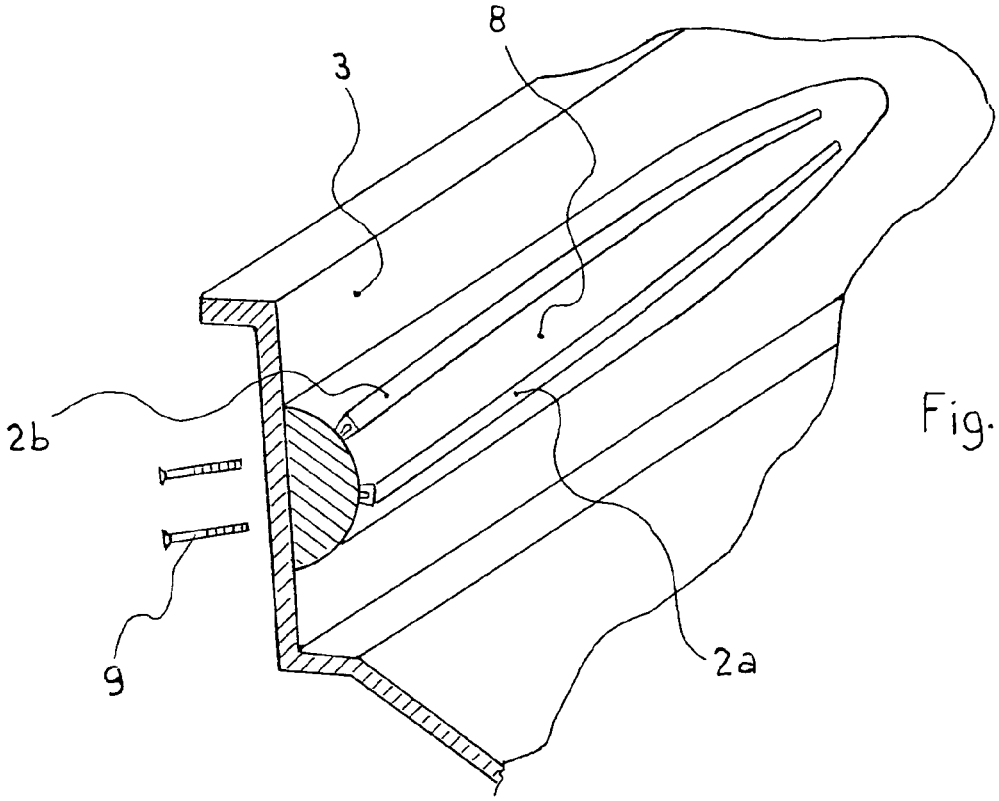
FIG. 5 is a partial cross-sectional view of the mould partially illustrated in FIGS. 3 and 4.

Particularly, according to the advantageous embodiment of the method of the present invention to which FIGS. 3–5 are referred, the linear guides 2*a*–2*b* are removably fastened to the mould 3 in an indirect manner, i.e. they are clamped to a suitably shaped insert 8 which is in turn clamped to the mould 3 of the hull 1. The subsequent laminating of the plastic or composite material to manufacture the hull 1, is thereby carried out upon the mould 3 carrying the insert 8 retaining the guides 2*a*, 2*b* to be embedded within the hull 1.

The convex insert 8 to which the linear guides 2*a*, 2*b* are removably fastened allows to manufacture a concave portion 6 (see FIG. 1) of the hull 1 in which the corresponding tubular element is accommodated in a partially embedded manner.

As will be understood by those skilled in the art, the same mould 3 can be employed both to obtain a conventional hull without tubular elements, and accordingly without guides 2*a*, 2*b*, and to make a hull 1 which, according to the present invention, involves the presence of linear tubular element-holding guides 2*a*, 2*b* being embedded within the same hull 1 and also provides, according to a peculiar aspect of the invention, that the same tubular elements are at least partially embedded within the same mould 1.

Figure 6:
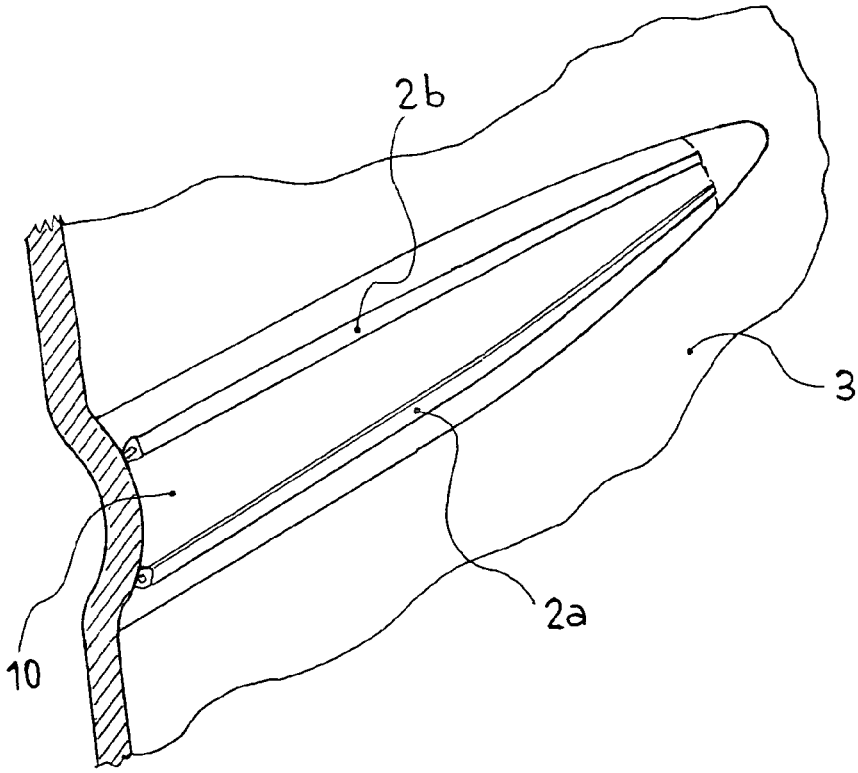
FIG. 6 is a partial cross-sectional view of a mould according to another aspect of the present invention.

In alternative embodiments of the method according to the present invention, with reference to FIG. 6, the guides 2*a*, 2*b* can be however directly clamped in a removable manner to the mould 3, which is suitably shaped for the exclusive manufacture of boats provided with tubular elements according to the present invention.

The ends proximate to the mouth of the concavity 7 of each guide 2*a*, 2*b* have a "rayed" outer surface, i.e. a outer surface which is cross-sectionally concave (see for example FIG. 2), in order to facilitate the laminating of pultruded material thereupon. In fact, the presence of this concavity facilitates the adherence of the fibre layers when the resin is being laid down.

In the preferred embodiment of the method according to the present invention, such as represented with reference to FIGS. 3–5, the removable clamping of the guides 2*a*, 2*b* onto the insert 8 may preferably be carried out by a longitudinal pin 4 which, by being inserted within the concavity 7 of each guide 2*a*, 2*b*, is in turn clamped to the insert 8 by anchoring threaded means, such as one or several bolts 5. The latter allow, by being tightened as desired, to easily clamp the pin 4 in the most suitable position.

The insert 8 can be fastened to the mould 3 by means of clamping screws 9 which are inserted from outside the same mould 3, firmly hold the latter, and are engaged with relative threaded seats (not shown) obtained on insert 8.

In the embodiment in FIG. 6, on the other hand, the pin 4 is clamped, by the threaded means 5, directly on the mould 3, at a shaped portion 10 thereof.

The longitudinal pin 4, that can run, either completely or partially, along each guide 2*a*, 2*b* is such shaped as to be easily taken off, i.e. removed, from each guide, upon completion of the laminating process and after the bolts have been unscrewed 5.

The guides 2*a*, 2*b* can be further sufficiently elastic to follow, without a preceding deformation operation, the profile of insert 8, or mould 3 and thus of hull 1, thereby further facilitating the manufacture of the positioning and retaining system according to the present invention.

After having fastened the guides 2*a*, 2*b* to the insert 8 and the latter to the mould 3 (or directly the guides 2*a*, 2*b* to the mould 3, such as in the embodiment from FIG. 6), the laminating of a plastic or composite material, particularly fibreglass, on the same mould 3, according to the traditional laminating techniques for the manufacture of a boat hull, allows to easily obtain a hull 1, or at least a superficial layer thereof, provided with guides 2*a*, 2*b* embedded therein.

Upon completion of the laminating process, after having unscrewed the bolts 5 and removed the pins 4 to release the guides 2*a*, 2*b* from the insert 8 (or from the mould 3 in the case of the embodiment from FIG. 6), and after having removed the hull 1 from the mould 3, the guides 2*a*, 2*b* will be firmly clamped to the hull 1 by chemical fastening, due to the laminating, and/or by contrast of parts, due to the particular shape taken by the linear guides 2*a*, 2*b* (for example being equipped with recesses, biased parts or undercut) for the mechanical coupling with the same laminate.

Particularly, if the guides 2*a*, 2*b* are manufactured by pultrusion in a composite material, i.e. by pressure drawing unidirectional fibers (glass, kevlar or carbon fibers) arranged in a resin matrix added with a catalyst and subsequently leaving this drawn to cool in order to obtain the desired shape, the simple laminating of the plastic or composite material composing, at least in part, the hull 1 on these guides 2*a*, 2*b*, generates a strong structural fastening, due to the similarity of the materials, and thus a better adherence of these materials, which in this case is both mechanically and chemically obtained.

As it can be seen in FIGS. 2 and 3, the outer lateral shape of each guide 2*a* and 2*b* is suitably tapered towards the opening portion of the concavity 7, such that the material composing the hull 1, following the laminating, defines a retaining channel for the latter on the guides 2*a*, 2*b*.

The boat thus obtained, being prearranged for coupling with removable tubular elements such as inflatable floating, stabilization and/or safety tubular elements, will not have protruding guides, which might be dangerous for the user, and in the meanwhile it will allow the efficient and long-lasting fastening of this removable tubular elements to the hull 1, due to the presence of the guides 2*a*, 2*b* being embedded in the same hull 1.

The invention claimed is:

1. A method for manufacturing a positioning and retaining system for removable tubular elements to be fastened to the hull of a boat of the type including at least one guide embedded in said hull, said guide being shaped to accommodate at least one complementary removable tubular element, the method comprising:

a) removably clamping indirectly to a mould of the hull at least one guide that is shaped to accommodate a complementary removable tubular element, said at least one guide being removably clamped to a shaped insert, being in turn removably fastened to said mould; and b) laminating on said mould carrying said at least one guide a suitable amount of plastic or composite material to manufacture said hull with said at least one guide being accessible from an exterior of said hull to receive said complementary removable tubular element.

2. The method according to claim 1, wherein said step of removably clamping said at least one guide to the mould is carried out by means of a guide-holding pin, being mechanically clamped to said mould or said insert.

3. The method according to claim 2, wherein said pin is clamped to said mould or said insert by means of anchoring threaded means.

4. The method according to claim 3 further comprising, following said laminating step, the steps of:

a) releasing said at least one guide from said mould or said insert; and b) removing the mould from the laminated material being a boat hull.

5. The method according to claim 4, wherein said step of releasing said at least one guide from said mould or said insert is carried out by unscrewing said anchoring threaded means.

6. The method according to claim 1, wherein said at least one guide is made in a metal or composite material.

7. The method according to claim 1, wherein said laminated material is pultruded fibreglass.

8. The method according to claim 1, wherein said at least one guide is such shaped as to provide a coupling by contrast of parts with the hull material, during said laminating step.

* * * * *